United States Patent [19]

Benaroya et al.

[11] Patent Number: 4,623,459

[45] **Date of Patent: * Nov. 18, 1986**

[54] APPARATUS FOR SELECTIVELY TAKING UP A LAYER OF POLLUTANT FROM THE SURFACE OF A BODY OF WATER

[76] Inventors: Henry Benaroya, 41, boulevard du Commandant Charcot, F-92200 Neuilly sur Seine; Jean Le Foll, 14, avenue de l'Europe, F-78160 Marly le Roi; Jean-Elie Cadoux, Le Mesnil Hubert en Exmes, F-61230 Gace, all of France

[ * ] Notice: The portion of the term of this patent subsequent to Jan. 1, 2002 has been disclaimed.

[21] Appl. No.: 646,246

[22] Filed: Aug. 31, 1984

Related U.S. Application Data

[63] Continuation-in-part of Ser. No. 521,760, Nov. 23, 1982, Pat. No. 4,491,518.

[30] Foreign Application Priority Data

| | | | |
|---|---|---|---|
| Nov. 23, 1981 | [FR] | France | 81 21905 |
| Dec. 18, 1981 | [FR] | France | 81 23741 |
| Sep. 1, 1983 | [FR] | France | 83 14051 |

[51] Int. Cl.[4] ..... E02B 15/04

[52] U.S. Cl. ..... 210/242.3; 210/512.1; 210/923

[58] Field of Search ..... 210/776, 177, 220, 788, 210/242.2, 242.3, 512.1, 512.3, 923

[56] References Cited

U.S. PATENT DOCUMENTS

| | | | |
|---|---|---|---|
| 1,996,547 | 4/1935 | Mason | 210/512.1 |
| 3,656,619 | 4/1972 | Ryan | 210/776 |
| 3,951,810 | 4/1976 | Crisafulli | 210/776 |
| 3,957,646 | 5/1976 | Wickert | 210/776 |
| 4,001,121 | 1/1977 | Bielefeldt | 210/512.3 |
| 4,151,081 | 4/1979 | Bolli | 210/776 |
| 4,391,708 | 7/1983 | Le Foll | 210/512.3 |
| 4,428,319 | 1/1984 | Henning | 210/242.3 |
| 4,491,518 | 1/1985 | Benaroya | 210/512.1 |

FOREIGN PATENT DOCUMENTS

| | | | |
|---|---|---|---|
| 80/00721 | 4/1980 | PCT Int'l Appl. | 210/242.3 |
| 83/01799 | 5/1983 | PCT Int'l Appl. | 210/242.3 |

*Primary Examiner*—Ernest G. Therkorn

*Attorney, Agent, or Firm*—Larson and Taylor

[57] ABSTRACT

The apparatus for selectively skimming a layer of pollutant from the surface of a body of water comprises a hull having two lateral parts and a vertical central part, placed between the lateral parts and projecting forwards with respect to the lateral parts. The parts define channels directing a flow of water and pollutant to pollutant-water separators in the hull. The central part carries immersed deflector wings shaped for creating vortices in said water body which decrease divergence of the flow lines in the vicinity of free water level around the hull. Each lateral part cooperates with the central part to define an open water trapping channel which authorizes water flow under a front portion of the lateral part. A front end portion of each lateral part is connected to an immersed part of the central part which is located forward of the stem of the associated lateral part by a vane arranged for deflecting the flow lines of deeper layers downwardly and outwardly away from the central part.

11 Claims, 8 Drawing Figures

APPARATUS FOR SELECTIVELY TAKING UP A LAYER OF POLLUTANT FROM THE SURFACE OF A BODY OF WATER

CROSS-REFERENCES TO RELATED APPLICATIONS

This application is a Continuation-in-Part of our prior co-pending Application Ser. No. 521,760, filed Nov. 23, 1982, now U.S. Pat. No. 4,491,518, resulting from International Application No. PCT/FR/82 00198 and claiming the benefit of our French Patent Applications Ser. Nos. 81 21905 and 81 23761.

BACKGROUND AND SUMMARY OF THE INVENTION

The invention relates to an apparatus for selectively taking up a layer of pollutant, particularly hydrocarbons, floating on the surface of a sheet of water and is of particular, although non-exclusive, interest in the depollution of oil-contamined ocean areas.

Such apparatuses are disclosed in U.S. Pat. No. 4,391,708 and in International Application No. WO/83 01 799 of the Applicants. U.S. Pat. No. 4,391,708 describes an apparatus which comprises a hull provided with propulsion means for running before the sea. The hull has a central part projecting forwardly with respect to two lateral parts which define, with the central part, ducts leading to separators. The central part has deflector means, such as fins, for creating swirls or vortices whose orientation tends to reduce the divergence of the surface flow lines around the hull.

One of the functions of the deflector means is to achieve surface sweeping of an area of the sea between flow lines which have a much greater separation upstream of the apparatus than they would have had in the absence of the deflector means. Consequently, the pollutant layer is thicker at the intake of the ducts opening into the separators. That thickening effect is however not sufficient to increase the pollutant content of the mixture delivered to the separator to a sufficient extent. For further increasing the thickening effect along the open flow up to the separator means, there is disclosed, in International Patent Application No. WO/83 01 799 and the parent application, a construction for trapping liquid between the lateral parts and the central part which includes a floor having a negative lift profile. The leading edge of that floor protrudes forwardly of the ducts and slows down the flow in a zone upstream of the leading edge. The trapped flow is minimized by decreasing the size of the water layer above the trapping threshold consisting of a floor and correlatively decreasing the flow speed above that threshold for maintaining a flow of fluvial type, which requires a Froude number $v/\sqrt{gh}$ lower than 1. That approach provides satisfactory results only as long as the variations of the free level above the floor are of limited amplitude and it is difficult to achieve slowing down while completely avoiding local divergence of the surface flow.

It is an object of the invention to provide an improved apparatus in which the pollutant layer is progressively thickened without any substantial divergence of the surface flow lines. For that result, the trapping action is split into two successive steps:

a superficial trapping, or partitioning consisting in "cutting" the free level of the water sheet by stems of the lateral parts, whose front portion has a depth which is lower than that of the central part, whereby a barrier is formed for the pollutant layer, while in-depth communication is retained and water flows occur from one side to the other of the lateral part;

a complete trapping action, which is effective from the leading edge of an immersed floor which connects the central part to each lateral part, far downstream of the stem of the lateral part.

The bottomless channel which is defined by the external wall of the central part and the internal wall of each lateral part has a width which progressively decreases in a zone upwstream of the immersed floor. Then, there occur a progressive thickening of the pollutant layer and simultaneously water removal from that channel, due to an oblique circumventing flow under the lateral part.

If used alone, such an arrangement would not make it possible to avoid a divergence of the surface flow, upstream of each lateral stem and separation of the flow from the hull surfaces.

For that reason, the front part of each lateral wall is provided with vane means which connect the front portion of each lateral part, immediately behind the stem, with an immersed portion of the central part, forwardly of the stem of the lateral part where that stem cuts the water line. The vane is designed for deflecting the flow lines in the deeper water layers downwardly and outwardly (i.e. away from the longitudinal midplane of the hull). The greater portion of that vane from the central part may be shaped as a swept back wing having a constant chord and an invariant profile, for instance NACA 4515. The undersurface of the vane is not flat, but rather spirally wounded over approximately 90°. Then, the underline of each profile constitutes a line of a cylinder parallel to the axis of the cylinder. The flow is then deflected by an amount which depends on angles $\alpha$ and $\beta$ which are the angles between the axis of the cylinder with an horizontal plane and with the vertical midplane of the apparatus, respectively. The vane is connected to a downwardly directed extension of the front portion of that lateral part.

It will be appreciated that the vane intended to avoid divergence of the surface flow line has a shape and a function which are fundamentally different from those of the wing disclosed in Internationnal Patent Application No. WO/83 01799. The function of the latter wing is to compensate for the detrimental side effect of a trapping floor whose leading edge projects forwardly of the lateral parts.

The immersed floor for final trapping preferably has a convex lower surface. The leading edge of that floor is preferably substantially horizontal and swept back in a portion which is close to the central part of the hull. Then, it has a lesser swept back angle and exhibits an upward slope. Finally, the leading edge merges with the vertical profile of the lateral part of the hull. That lateral part is curved downwardly for connection with the floor.

That arrangement makes it possible to locate the vane at a substantial depth, since the vane is not used any longer for limiting the flow rate above it. The flow which is trapped is of course greater than in the arrangement described in application No. WO/83 01799, but the rate of flow is progressively decreased due to progressive removal caused by the vane which exhibits a positive lift and by the floor shaped to provide a negative lift. They induce velocities in the deeper part of the trapped streams which have a downwardly directed component and an outwardly directed lateral component. That change of direction results in a by-pass flow under the lateral part of the hull. The rate of flow after final trapping may be a fraction which is of from 20 to 25% of the rate of flow which enters the channel above the vane. As a consequence, the depth of immersion of the vane may be increased without drawback. Since drainage of the deeper layers is carried out after superficial trapping, there is neither pollutant loss, nor lateral overflow beyond the stems of the lateral parts.

Angles $\alpha$ and $\beta$ are selected for avoiding substantial divergence upstream of the stem of each lateral part. That implies that $\alpha$ and/or $\beta$ have a positive value, which is however low enough for avoiding disturbance of the flow in the layer close to the surface by the vane. $\alpha$ and $\beta$ may generally have values of about 24° and 18°, respectively.

Roughness of the sea, particularly due to swell and waves, causes an other difficulty which should also be solved. Breakers may invade the trapping channels in countercurrent with the flow, between the central part and the lateral parts of the hull. In the apparatus of application No. WO/83 01799, that problem was solved by locating a spillway or overfall on the flow path between trapping and discharge. That approach requires pumps which are able to operate under quite variable load and power conditions. It is a further object of the invention to provide a construction which does not require such pumps. It is a more specific object to make it possible to use propulsion pumps which operate at constant speed and power under steady conditions.

For that purpose, the flow which has been finally trapped is fractionated into three distince partial flows. Fractionation is achieved by two additional thresholds provided in addition to the first threshold constituted by the front part of the floor.

The second threshold has a substantially horizontal leading edge which is so located that the greater part of the flow (typically 65 to 70% of the average value of the finally trapped flow) circulates under that second threshold. That greater portion is directly delivered to a propulsion pump which operates at constant power and speed under steady conditions. That greater part represents a flow rate which remains substantially constant during a full period of the wave.

The third threshold is so located that an open flow circulates above it which represents some percents only of the trapped flow. The pollutant is included in that partial flow which is directed to separator means which may be as described in application No. WO/83 01799 and the parent application.

The confined flow between the second and third thresholds or sills by-passes the separator means. It is discharged, in the form of a water sheet overflowing a tangential spillway, into the well of a wave compensator, which will be described later. The pollutant-free flow from the separator means is preferably delivered into that same well, over a second spillway.

Relative movement of the sea and the hull, due to swell and waves, results into a periodical variation of the water height and head in the channels defined by the parts of the hull. That variation occurs with a period which is equal to that of the apparent swell. For avoiding reflection of the compression waves which circulate along the channel when the head varies at the entrance of the channel, the overall flow rate which is trapped should increase at a high rate when the head at the rear of the channel increases. The first of the three partial flows is constant and consequently the variation of the trapped flow as a function of the head should be almost instantaneously provided by the other two partial flows. For that result, the pipes or ducts upstream of the spillways which open into the well of the compensator should fulfil two conditions:

the head loss of three water flow under steady conditions should represent a low fraction only of the reference dynamic pressure $\rho V^2/2$, where V designates the speed of advance of the apparatus through the water body and $\rho$ is the density;

the inertia of the liquid column should be low enough for the pressure difference between the ends of the pipe caused by acceleration of the flow corresponding to a variation of the flow rate remains low as compared with the reference dynamic pressure $\rho V^2/2$.

The two conditions may be fulfilled with pipes having a sufficiently large flow cross-sectional area. The variations of the level and head are then substantially in phase at the two ends of each pipe, at least when the frequency of the swell is within the range which is currently found at sea.

The relation between the flow rate above a spillway and the thickness of the overflowing sheet of water is such that there is no difficulty in obtaining a large value of the derivative $dq/dz_0$ (q being the rate of flow and $z_0$ being the head $z+V^2/2g$). It is well known that the rate of flow is in direct relation with power 3/2 of the thickness of the overflowing sheet. As a practical rule, it is sufficient that the head downstream of the spillway, that is in the well which receives the variable flow rate circulating between the second and third thresholds, is always low enough for the Froude number above the spillway to be higher than about 0.5.

For the spillway to be effective in avoiding reflection, the variable flow rate which is discharged into the well should be removed while maintaining such a level in the well that there is a a free and continuous overflow above the spillway. That result may sometimes be obtained by connecting the bottom of the well to the water body through a spirally shaped pipe which has a rearwardly directed exhaust nozzle. Then, forward movement of the apparatus is sufficient to cause a flow from the well. However, recovery of kinetic energy in the spiral may be too low for maintaining the water surface at a low enough level. It is consequently preferable to amplify or assist the rotation caused by tangential injection of the overflows with a motor driven pump.

The energy or power which is required from the pump remains moderate as long as the average ejection velocity is substantially lower than the speed of the apparatus. The pump should accomodate a quite variable flow rate and the rotor may even be partially uncovered at times. It should consequently have a rugged construction. It may consist of an axial pump which forces the flow downwardly. The rotor may however also be quite crude in nature, since it is of low power and a high yield is not an essential requirement. For instance a wheel with longitudinal paddles may be used. Such a wheel is of advantage in that there is no risk of cavitation. As a rule, the overall flow rate which is discharged into the well of the swell compensator may vary, during a period of the swell, between 10 and 40% of the average flow rate trapped during a period, while about 75% of the average rate is ejected by the propulsion pump.

The invention will be better understood from the following description of a particular embodiment given by way of example only.

SHORT DESCRIPTION OF THE DRAWINGS

Figure 1:
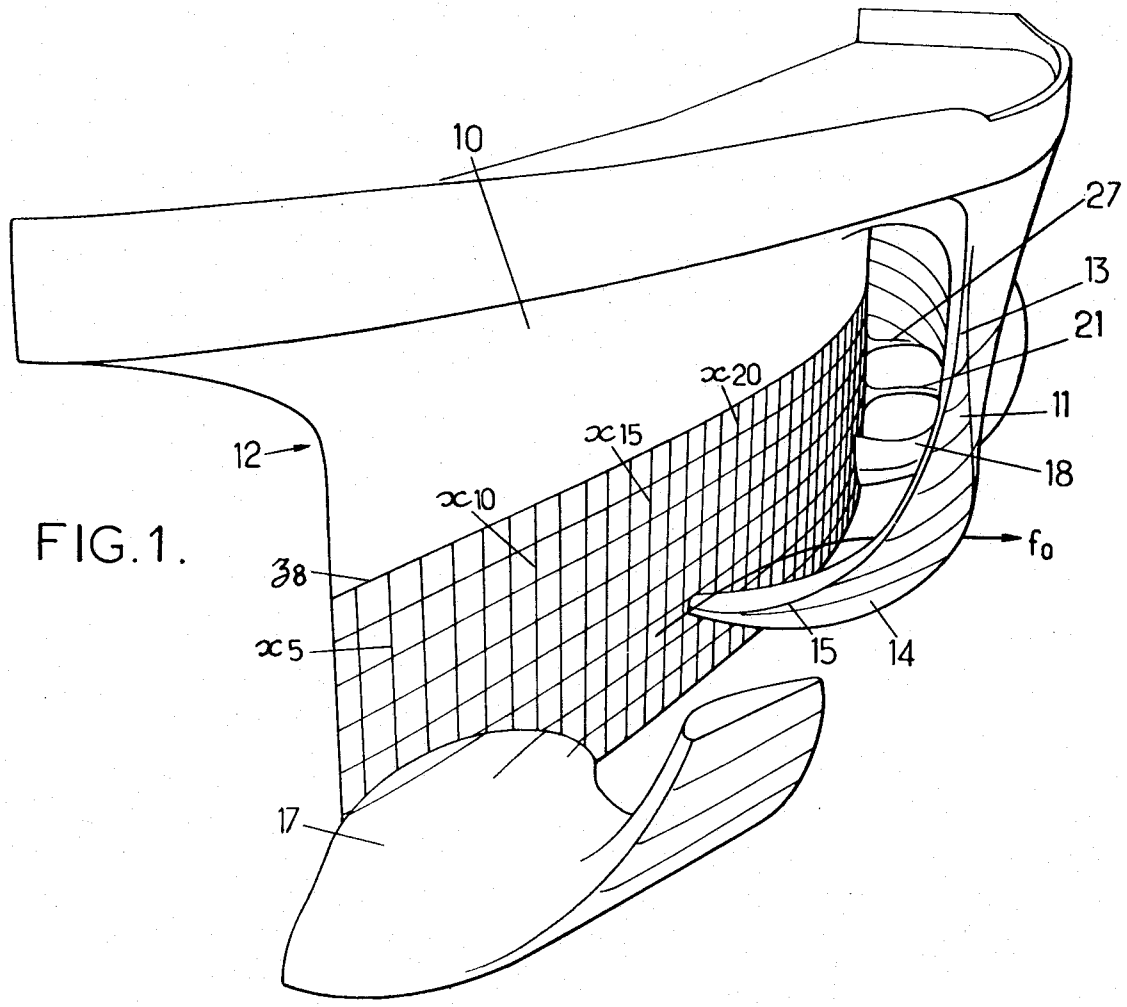
FIG. 1 is an isometric view showing the left hand portion of the hull of the apparatus, on which a grid of horizontal lines and vertical lines has been drawn with a spacing which is for instance of 30 cm.
Figure 2B:
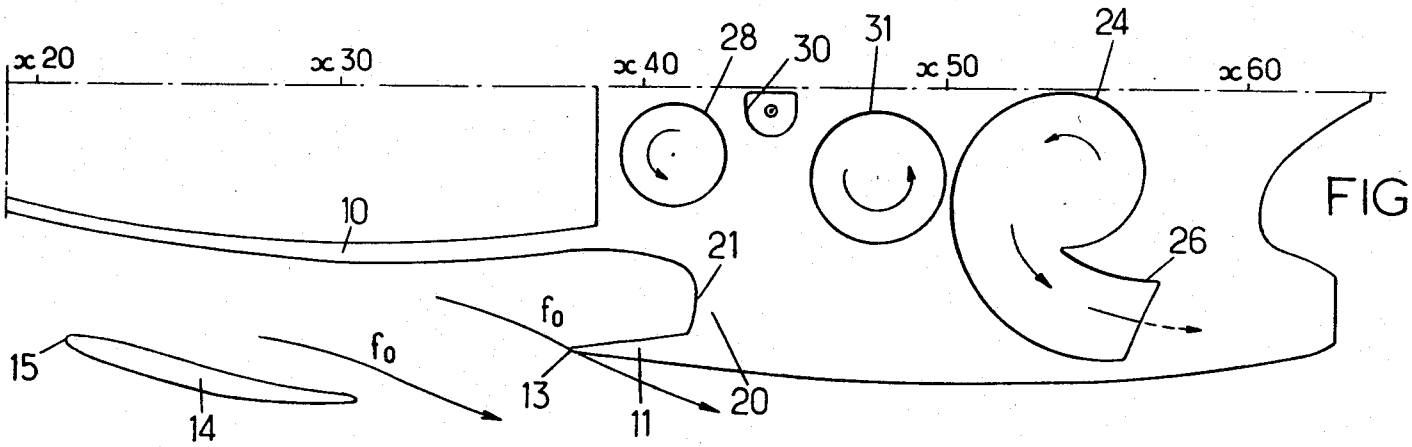
FIG. 2A is a cross-section at the water line (level $z_8$) on which the cross-section of the pipes at level $z_6$ of FIG. 1 also appears.
Figure 2A:
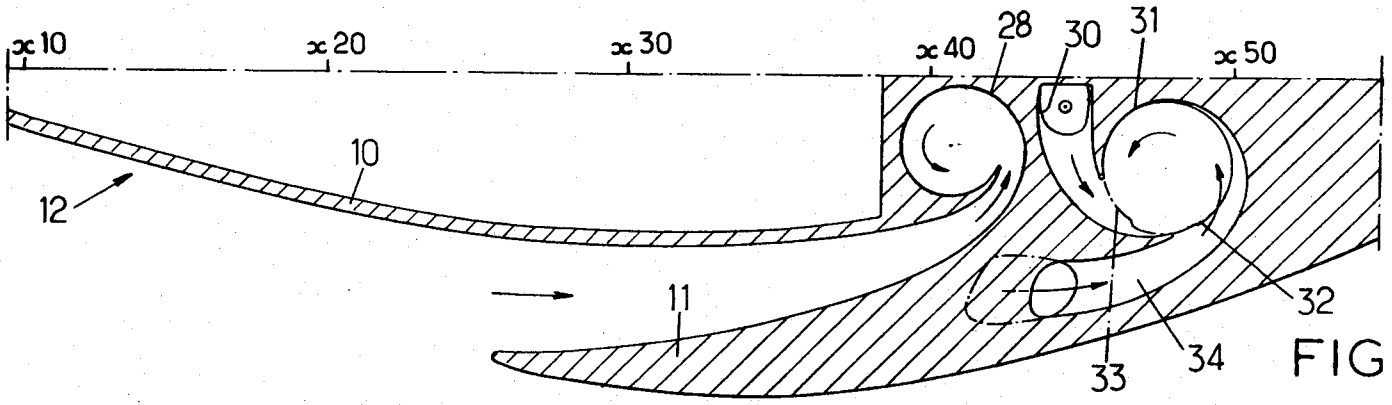
Figure 3:
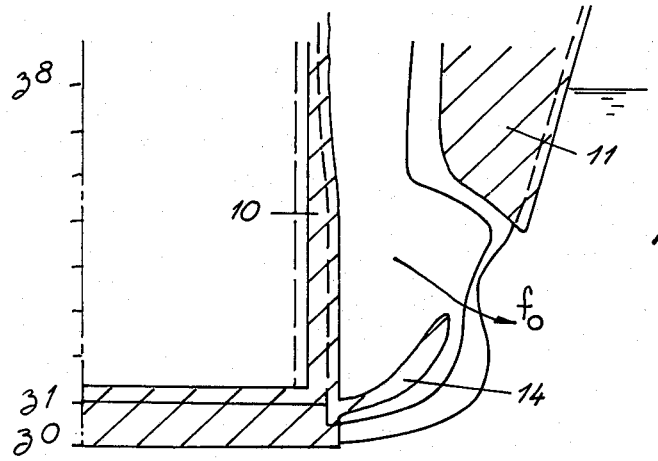
Figure 4:
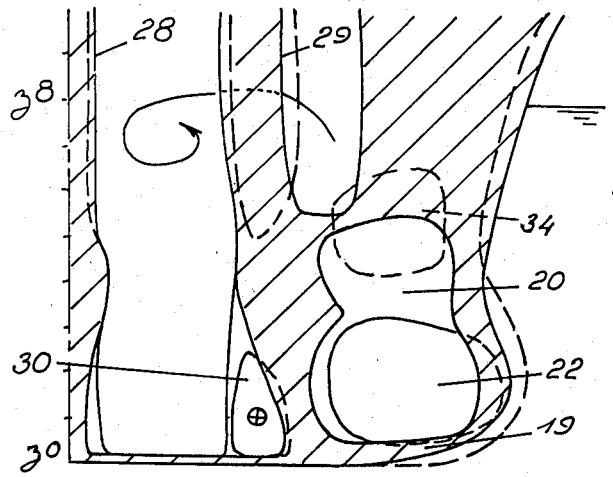
Figure 5:
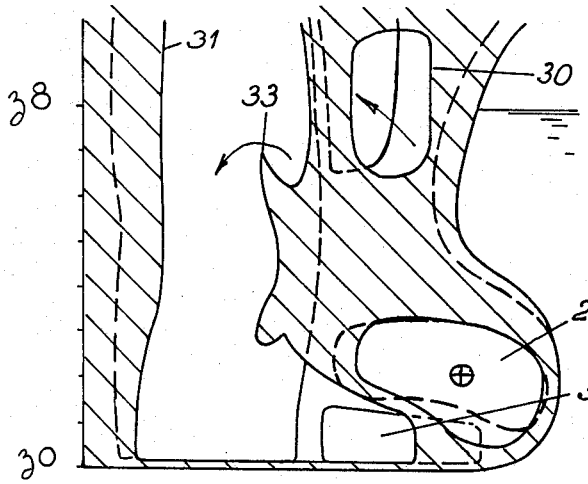
Figure 6:
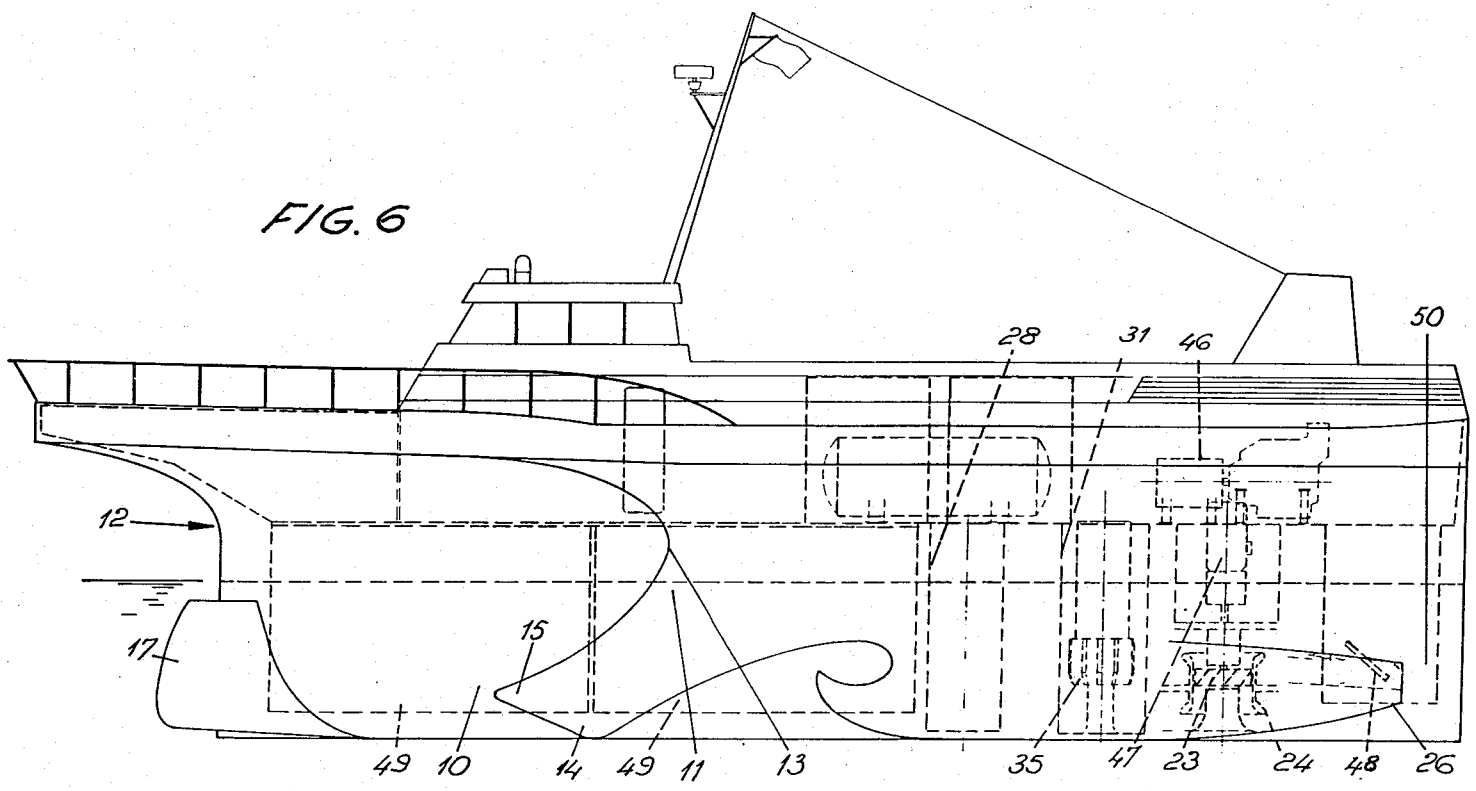
Figure 7:
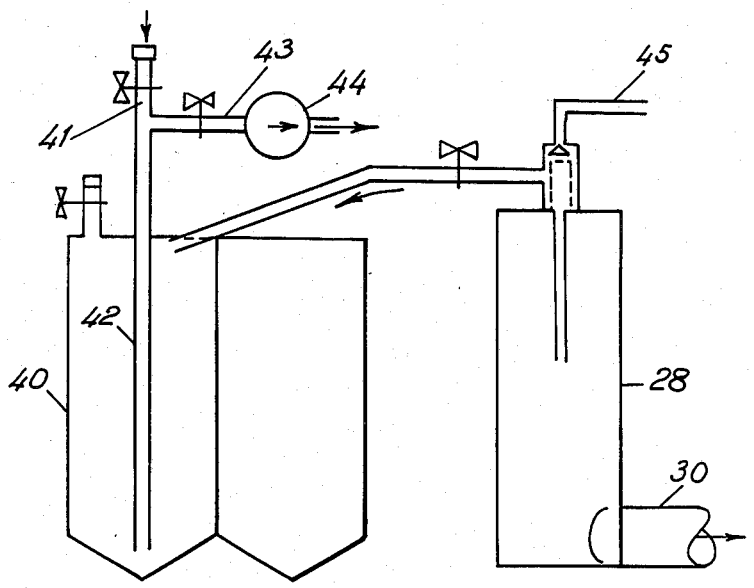

FIG. 2B, similar to FIG. 2A, is a cross-section at level $z_4$ of FIG. 1;

FIG. 3 is a cross-section along frame line $X_{36}$ of FIG. 1, which also illustrates the shape at frame $X_{38}$;

FIGS. 4 and 5, similar to FIG. 3, are cross-sections along frames $X_{40}$ and $X_{46}$ of FIG. 1, also illustrating the shapes at stations $X_{42}$ and $X_{48}$, respectively;

FIG. 6 is an elevation view of the apparatus, indicating a possible internal arrangement;

FIG. 7 is a sketch which illustrates a settling device for increasing the pollutant content.

DETAILED DESCRIPTION OF A PARTICULAR EMBODIMENT

The apparatus which will now be described is designed for operating either in the coastal range or while being assisted by a tanker which may cooperate with several apparatuses working at the same time. The tanker is then used for provisional storage of the collected pollutant. The apparatus will typically have a length of about 20 m and a width of about 7 m. Due to the small length, the ratio between length and the draft, typically about 2.40 m for operation in rough seas) will be much lower than that which will be selected for an apparatus intended to operate without support on the high sea, having a large storing capacity and a much increased length. Referring to FIGS. 1 and 2, the apparatus has a hull generally indicated at 12 which comprises a central part 10 and two lateral parts 11. The confronting surfaces of the central and lateral parts define collecting channels which have a generally spiral shape. The lateral surfaces which constitute the sides of the central part are substantially vertical, as indicated in FIG. 1. Such sides strongly limit the stem wave which would generate turbulences.

The general arrangement of the apparatus is similar to that described in application No. WO/83 01 799 and U.S. Ser. No. 521,760, now U.S. Pat. No. 4,491,518 to which reference may be made. On the other hand, it is however designed for achieving trapping, then progressive fractionation, as follows:

the flow rate which is trapped in the upper layer of the water body is progressively fractionated until only 20–25% of the original flow rate is retained, that result being obtained by deviating the deep layers, before final trapping, the flow rate which has been finally trapped above a sill constituting a first threshold is again fractionated. The deeper portion of the flow, which represents 65–70% of the average finally trapped flow, is diverted as a confined flow between the first threshold and a second threshold located above and rearwardly of the first threshold. That fraction of the flow rate is delivered to a propulsion pump which operates at constant speed and power under steady conditions, the flow rate, having a quite variable magnitude, which circulates above the second threshold is again fractionated by a third threshold. That part which is taken between the two thresholds represents 20 to 30% of the finally trapped flow rate. It is delivered by a siphon to a spillway provided for avoiding upflow of breakers and is discharged to the water body, last, the flow above the third threshold, which represents some percent only of the originally trapped water flow, is directed to centrifugal separator means which may be as described in application No. WO/83 01799. The pollutant free water collected at the bottom of the separators is merged with the water flow taken between the second and third thresholds.

The arrangements which make it possible to increase the thickness of the pollutant liquid layer, then to fractionate the trapped flow rate, will now be described. The arrangements will be described successively, as they appear from the front to the rear of the apparatus.

Front deflector means

As illustrated in FIG. 1, the deflectors consist of a swept-back front wing 17 of curved shape, as described in the patent application.

Thickening and trapping of the pollutant layer

Superficial trapping is achieved by the stem 13 of each lateral part 11 and by the associated vane 14. Referring to FIGS. 1, 2, 3 and 6, the front portion of each lateral part 11, immediately aft of the stem 13, extends downwardly as a twisted wall which merges with vane 14. Vane 14 is connected to the lower portion of the central part 10, at a place which is located far forwardly of stem 13. The vane 14 is for deflecting the flow downwardly and outwardly. It has a profile with a constant chord, with a flat underside.

The underside is spirally wound on an angle of about 90° and may be considered as a portion of a cylindrical surface whose axis intersects the horizontal plane and the vertical midplane of the hull. The angles of that axis with an horizontal plane and with a vertical plane (not shown) will be designated with $\alpha$ and $\beta$ respectively. The leading edge 15 of the vane 14 is horizontal in the portion close to the central part 10 and is strongly swept back. Then, the sweep angle decreases while the leading edge winds up for merging with the apparent contour line of the lateral part 11. At the root of the vane 14, where it is connected to the central part, vane 14 is at a maximum depth, which is almost equal to the draft of the apparatus. This is without drawback since there is no need to limit the flow rate above the vane.

The vane 14 and the stem 13 of the lateral part cooperate to deflect the deep layers, as indicated by arrows $f_0$ on FIGS. 1, 2B and 3. That deflection diverts part of the initially trapped flow. The finally trapped flow represents no more than 25% of the flow which is intaken through the sectional area defined by the parts of the hull and the vanes.

Final trapping occurs above the first threshold, i.e., partitioning floor 18 which connects to the lateral part 11 between stations $X_{37}$ and $X_{38}$ (FIG. 3). That threshold is defined by the front portion of a submerged floor or sill 19 (FIG. 4). A second threshold, i.e., partitioning floor 20 is located above sill 19 and its leading edge 21 is located aft of that of the first threshold 18 (FIGS. 1 and 2B). The second threshold fractionates the finally trapped flow. Referring to FIG. 4, the second threshold is located between stations $X_{40}$ and $X_{42}$, far behind the first threshold. It defines a pipe or duct 22 which opens into a main propulsion pump 23 located in a chamber 24 (FIGS. 2B and C). The propulsion pump forces water into a discharge passage 26 opening at the rear of the apparatus.

Separation

A third threshold 27 is located at a level higher than that of the second threshold, i.e., partitioning floor, between levels $z_5$ and $z_6$ in the illustrated embodiment. Threshold 27 again fractionates the flow which has not been taken through pipe 22. The surface flow, which represents some percent only of the overall rate of flow circulating above threshold 18, is directed to a centrifugal separator 28. Referring to FIGS. 2A and 2B, which are two cross-sections at different levels, water is introduced tangentially into the separators. Referring to FIG. 4, the pipe 29 which feeds the separator is located at the upper portion of the separator well while the pipe 30 for discharging depolluted water opens at the lower part of the well. Pollutant and polluted water are pumped out from the higher central portion of the swirl which is generated in the well by tangential delivery and removal of water. That pollutant is directed to pollutant storage tanks, as will be described later.

Compensation of swell

Pollutant-free water exiting from separator 28 through pipe 30 is delivered to a swell compensator 31, as well as water trapped between the second and third thresholds 20 and 27. The compensator includes a vertical approximately cylindrical well (FIGS. 2A, 2B, 5 and 6) provided with two tangential feed spillways 32 and 33 (FIGS. 2A and 5). Spillway 32 receives water through pipe 24 which originates from the opening between thresholds 20 and 27. The oblique spillway 33 receives pollutant-free water from pipe 30 which is of sinuous shape. Pipe 30 has an upward slope from the bottom of the separator, close to the midplane of the apparatus. Then pipe 30 exhibits a turn and opens obliquely with respect to spillway 33. Referring to FIG. 6, a rotor 35 is located in the swell compensator well 31 and maintains the free level of water in the well at a value which is low enough for a free falling overflow to occur continuously over the spillway. Water is removed tangentially from the lower portion of the swell compenstor well 31 and directed toward the rear of the apparatus.

A quite moderate power only is required for maintaining the rotation speed of the rotor at a constant value and for rapidly increasing the flow rate discharged through pipe 36 as soon as the water height in the well increases. Consequently, variations of height are attenuated. If there is lowering of the free level up to a point that the rotor is partially uncovered, the water flow through the spirally-shaped pipe 36 may draw air as bubbles. This does not represent a drawback as long as the ejection nozzle of pipe 36 is short and has a ceiling which is horizontal or slightly sloped upwardly.

As indicated above, the rotor may be of rugged condition and consist of a paddle wheel.

Storage

For removing the whole pollutant from the centrifuge separator 28, a volume of water should also be removed. That water may partially be separated from pollutant by settling.

Referring to FIG. 7, there is shown a construction including a plurality of polluted water storage tanks 40. The tanks are connected to separator 28 through a system of valves which may be used for distributing the water content in order to achieve draft trimming. Each tank is provided with a waste exit opening at the top of the tank. A line 42 immersed deeply within the tank is used for injecting water into the lower portion of the tank for forcing the pollutant-rich higher layer into the exit. Water is introduced into line 42 via a branch 41. Another branch 43 is provided with a stop valve and with an extraction pump 44. That pump is used for discharging pollutant-free water into the water body.

When the apparatus operates with support by a large tanker, the line 42 and the exit may be provided with fluid connectors: then, the power which is required for operation is delivered by the tanker. The system may also include a vacuum connection 45 to the pipe from separator 28 for priming transfer of pollutant-rich water.

The distribution of the components in the apparatus may be as illustrated in FIG. 6. Referring to FIG. 6, the polluted water tanks and the propulsion pumps 35 may be located at 49. The propulsion pumps may consist of an electric generator 46 connected to electric motors such as 47, each connected to a pump. Jet reversal flaps 48 may be located on the water ejection pipes 26 for braking or steering. The stern may be provided with vertical fins 50 for yaw stabilization.

We claim:

1. An apparatus for selectively skimming a layer of pollutant from the surface of a body of water, comprising: a hull provided with means for moving it in a predetermined direction through the body of water and having two lateral parts and a vertical central part, placed between the lateral parts, projecting forwards with respect to stems of the lateral parts in said predetermined direction and defining channels directing a flow of water and pollutant to separator means in said hull, said central part bearing first immersed deflector means shaped for creating vortices in said water body whose angular position decreases divergence of the flow lines in the vicinity of free water level around the hull, wherein each lateral part cooperates with the central part to define an open bottom channel for trapping of water and wherein a front end portion of each lateral part is connected to an immersed part of the central part which is located forward of the stem of the associated lateral part by vane means constituting additional immersed deflector means arranged for deflecting the flow lines of deeper layers in said channel downwardly and outwardly away from said central part, thereby causing part of the trapped water to escape from said channel under and across a front portion of said lateral part.

2. Apparatus according to claim 1, wherein a greater portion of said vane means from said central part consists of a swept-back wing having a subtantially constant chord and a flat undersurface, said undersurface being part cylindrical and spirally wound over about 90°, the shape of the wing being such that the underlines of the successive profiles are directed along longitudinal lines of said cylinder parallel to an axis of said part cylindrical surface.

3. Apparatus according to claim 2, wherein said axis of said cylindrical surface is at a positive angle with the horizontal plane and with a vertical midplane of said apparatus.

4. Apparatus according to claim 1, further comprising a submerged sill constituting a flow partitioning floor having a leading edge located at a level higher than said vane means and downstream thereof for defining a subchannel for water flow to separator means, said sill having a convex lower surface and said leading edge being strongly swept back in a zone close to said central portion.

5. Apparatus according to claim 4, further comprising: a second partitioning floor located above and behind said first partitioning floor; a third partitioning floor located above and behind said second partitioning floor for fractionating the flow defined by said central portion, each lateral part and the first partition floor into a surface flow, an intermediate flow and a bottom flow; propulsion pump means arranged to receive said bottom flow; and a swell compensator arranged to receive said intermediate flow; said separator means being arranged to receive surface flow circulating above said third partition floor.

6. Apparatus according to claim 5, wherein said fractional flow circulating between the first and second partitioning floor represents from 65 to 70% of the finally trapped flow.

7. An apparatus for selectively taking up pollutant from the surface of a body water, comprising a hull having two lateral parts straddling a central part which projects forwardly with respect to the lateral parts, submerged deflector means carried by a front portion of said central part forwardly of said lateral parts for generating vortices whose velocity decreases divergence of the surface flow lines around the hull, conduit means defined by said lateral parts and central part on each side of said central part, said conduit means having a submerged sill constituting the first partitioning floor having a leading portion, a second partitioning floor having a leading edge located above and aft of said leading portion and a third partitioning floor having a leading edge located above and aft of the leading edge of the second partioning floor, said partitioning floors being arranged for fractionating a flow trapped between said central part and lateral parts and directing a first fractional flow circulating between the second and third floors to a swell compensator accomodated in said hull and said third floor being arranged for directing another fractional flow which circulates above said third floor to separator means.

8. Apparatus according to claim 7, wherein said swell compensator comprises a vertical well, a motor-driven rotor in said well, a tangential spillway for delivery of said fractional flow circulating between said second and third thresholds to said well, and exhaust pipe means connecting a bottom portion of said well and exhaust nozzle at the rear of said apparatus.

9. Apparatus according to claim 8, wherein said motor-driven rotor is arranged for maintaining the free surface of water in said well at a level low enough for a continuous free overflow to occur above said spillway in operation.

10. Apparatus according to claim 8, wherein said well is further provided with a second spillway for delivery of pollutant-free water from said separator to said well.

11. Apparatus according to claim 7, wherein a partial flow circulating between said first and second thresholds is directed to propulsion pump means accomodated in said hull and discharging water rearwardly of said apparatus.

* * * * *